US006854445B2

(12) United States Patent
Okamoto

(10) Patent No.: US 6,854,445 B2
(45) Date of Patent: Feb. 15, 2005

(54) COMMON RAIL FUEL INJECTION APPARATUS

(75) Inventor: Kenji Okamoto, Saitama (JP)

(73) Assignee: Bosch Automotive Systems Corporation (JP)

( * ) Notice: Subject to any disclaimer, the term of this patent is extended or adjusted under 35 U.S.C. 154(b) by 0 days.

(21) Appl. No.: 10/486,178

(22) PCT Filed: Jun. 30, 2003

(86) PCT No.: PCT/JP03/08275

§ 371 (c)(1),
(2), (4) Date: Feb. 6, 2004

(87) PCT Pub. No.: WO2004/007945

PCT Pub. Date: Jan. 22, 2004

(65) Prior Publication Data

US 2004/0194762 A1 Oct. 7, 2004

(30) Foreign Application Priority Data

Jul. 10, 2002 (JP) ..... 2002-201412

(51) Int. Cl.[7] ..... F02M 37/04
(52) U.S. Cl. ..... 123/446; 123/506; 123/458
(58) Field of Search ..... 123/446, 447, 123/456, 458, 506

(56) References Cited

U.S. PATENT DOCUMENTS 4,381,750 A * 5/1983 Funada ..... 123/446
4,448,168 A * 5/1984 Komada et al. ..... 123/446
4,449,507 A * 5/1984 Mayer ..... 123/467
4,572,136 A * 2/1986 Takeuchi et al. ..... 123/447
5,622,152 A * 4/1997 Ishida ..... 123/446
6,422,203 B1 * 7/2002 Djordjevic ..... 123/456

FOREIGN PATENT DOCUMENTS

| | | |
|---|---|---|
| DE | 199 10 970 | 9/2000 |
| DE | 100 02 273 | 8/2001 |
| EP | 1 024 274 | 8/2000 |
| EP | 1 078 160 | 2/2001 |
| JP | 63-117147 | 5/1988 |
| JP | 2-191865 | 7/1990 |
| JP | 11-173192 | 6/1999 |
| JP | 2000-282998 | 10/2000 |
| JP | 2002-539372 | 11/2002 |
| JP | 2003-520317 | 7/2003 |
| WO | WO 00/55496 | 9/2000 |
| WO | WO 01/52916 | 7/2001 |

* cited by examiner

*Primary Examiner*—Thomas Moulis
(74) *Attorney, Agent, or Firm*—Connolly, Bove, Lodge & Hutz LLP

(57) ABSTRACT

In a fuel injection apparatus (1) configured so that high-pressure fuel from a common rail (2) is supplied to an injector (8) through a pressure booster (4), it is discriminated whether reduction of the fuel pressure in the common rail (2) is necessary, the spill amount of the high-pressure fuel necessary for pressure reduction is computed when pressure reduction is discriminated to be necessary, and a control solenoid valve (48) is open/close controlled to spill said spill amount of the high-pressure fuel to the low-pressure side at a time point when fuel injection from the injector (8) is not being conducted.

4 Claims, 5 Drawing Sheets

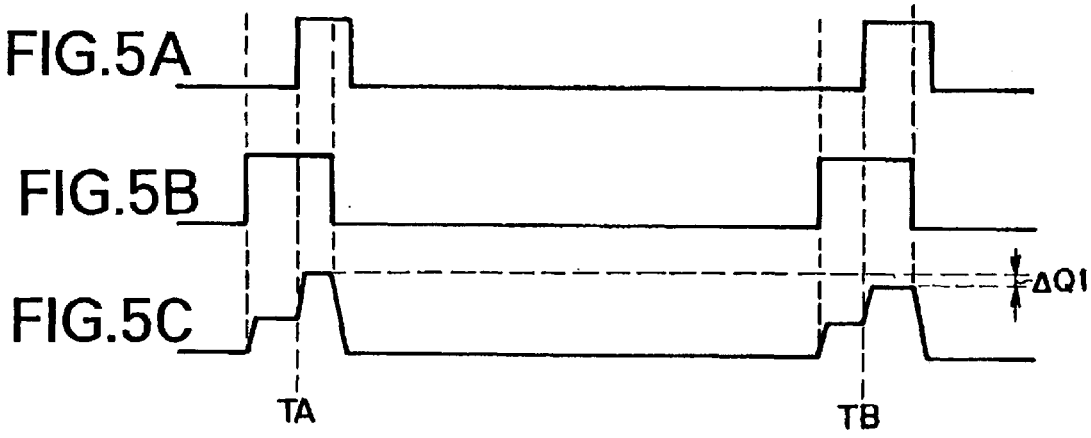
FIG.5A
FIG.5B
FIG.5C
ΔQ1
TA
TB
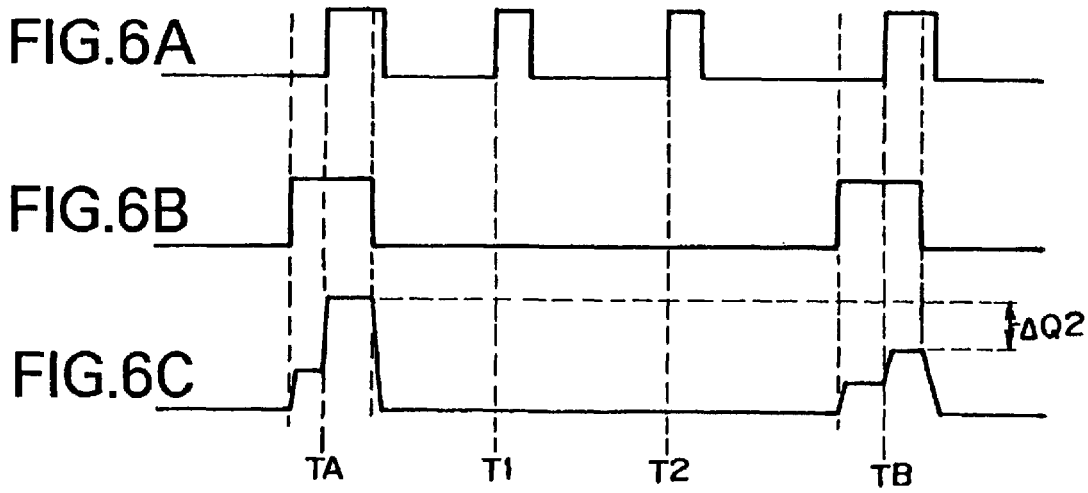
FIG.6A
FIG.6B
FIG.6C
ΔQ2
TA
T1
T2
TB

COMMON RAIL FUEL INJECTION APPARATUS

TECHNICAL FIELD

The present invention relates to a common rail fuel injection apparatus that injects/supplies high-pressure fuel once accumulated at high pressure in a common rail (pressure accumulation chamber) into diesel engine cylinders by means of injectors.

BACKGROUND ART

The conventional common rail fuel injection apparatus has the problem of causing problems in the operation of injecting fuel from the injectors. One of these is that when fuel injection is abruptly terminated because, for instance, the driver has taken his or her foot off the accelerator pedal to invoke engine braking effect, the rail pressure rises to above the desired pressure so that when fuel injection is resumed, high-pressure fuel is injected at one time within a short period. Japanese Unexamined Patent Publication No. Hei 11(1999)-173192, for example, teaches a configuration for overcoming this drawback by utilizing the fact that a delay arises between the time when the solenoid valve of an injector operates and the time when the valve body actually lifts to assume the valve-open state, i.e., by opening the solenoid valve of the injector in the course of this delay for a time period shorter than the delay, thereby spilling high-pressure fuel in the common rail to the low pressure side through the solenoid valve and lowering the rail pressure, without conducting fuel injection into the cylinder from the injector.

With this proposed configuration, however, the solenoid valve opening operation for lowering the fuel pressure in the common rail using the solenoid valve of the injector must be effected under very restricted conditions and, moreover, the fuel must be spilled within a period even shorter than the short period of about several msec during which the solenoid valve of the injector opens the valve body. Problems therefore exist in the points that the reduction rate of the rail pressure is difficult to increase, that when the operating state of the engine changes radically, it is hard to keep up by lowering the rail pressure to appropriate values, and that cases frequently arise in which optimum combustion cannot be achieved in the cylinder.

An object of the present invention is to provide a common rail fuel injection apparatus that enables the foregoing problems in the prior art to be solved.

Another object of the present invention is to provide a common rail fuel injection apparatus that enables reduction of rail pressure to be conducted rapidly.

Another object of the present invention is to provide a common rail fuel injection apparatus that enables fuel injection operation to be conducted stably.

DISCLOSURE OF THE INVENTION

The present invention concerns a common rail fuel injection apparatus configured to send high-pressure fuel once accumulated in a common rail to injectors through a pressure booster, specifically to one that enables reduction of rail pressure to be conducted at high speed by using a boost pressure control solenoid valve installed in the pressure booster to spill high-pressure fuel in the common rail to the low-pressure side.

The charactering feature of the present invention is the point that, in a common rail fuel injection apparatus configured so that high-pressure fuel from a common rail for accumulating fuel supplied under pressure from a fuel supply pump is sent through a pressure booster to an injector open/closed controlled by fuel injection control means and wherein pressure boost control in the pressure booster is conducted by using a control solenoid valve to regulate the amount of the high-pressure fuel supplied to the pressure booster that is spilled to the low-pressure side, there are provided discrimination means for discriminating whether reduction of the fuel pressure in the common rail is necessary, spill amount computing means for computing a high-pressure fuel spill amount necessary for pressure reduction when the discrimination means discriminates that pressure reduction is necessary, and solenoid valve control means responsive to the spill amount computing means and the fuel injection control means for open/close controlling the control solenoid valve so as to spill the high-pressure fuel to the low-pressure side at a time point when fuel injection from the injector is not being conducted.

Since rapid reduction of the rail pressure is performed by using the control solenoid valve preinstalled in the pressure booster to spill high-pressure fuel in the common rail to the low-pressure side, the rail pressure can be effectively reduced in a short time, merely by making minor changes in the configuration of the control section or to its program. Therefore, the configuration enables the rail pressure of the common rail to be reduced more rapidly than heretofore despite its low cost, and since any abrupt fuel injection termination operation that occurs can be prevented from giving rise to problems in the fuel injection operation thereafter, it is possible to realize a common rail fuel injection apparatus that is low in cost and high in performance.

The control solenoid valve can be configured to be open/close controlled so as to spill the high-pressure fuel to the low-pressure side for a prescribed time period at said time point. Further, spill amount computing means for computing a high-pressure fuel spill amount necessary for pressure reduction can be further provided, and the solenoid valve control means can be adapted to open/close control the control solenoid valve in response to the spill amount computing means and the fuel injection control means so as to spill said spill amount of the high-pressure fuel to the low-pressure side at a time point when fuel injection from the injector is not being conducted. A configuration can be adopted wherein the discrimination means includes desired pressure computing means for computing a desired pressure of the common rail and a rail pressure sensor for detecting actual pressure of the common rail and discriminates whether pressure reduction is necessary by comparing the desired pressure and the actual rail pressure.

BRIEF DESCRIPTION OF THE DRAWINGS

FIG. 5A is a graph showing the open/close operation of a control solenoid valve in the case of not conducting common rail pressure reduction operation.

FIG. 5B is a graph showing the fuel injection operation at the injector in the case of not conducting common rail pressure reduction operation.

FIG. 5C is a graph showing the time-course change in the fuel injection from the injector, etc., in the case of not conducting common rail pressure reduction operation.

FIG. 6A is a graph showing the open/close operation of the control solenoid valve in the case of conducting rapid pressure reduction.

FIG. 6B is a graph showing the fuel injection operation at the injector in the case of conducting rapid pressure reduction.

FIG. 6C is a graph showing the time-course change in the fuel injection from the injector, etc., in the case of conducting rapid pressure reduction.

BEST MODE OF CARRYING OUT THE INVENTION

In order to clarify the present invention in greater detail, it will now be explained with reference to the attached drawings.

Figure 1:
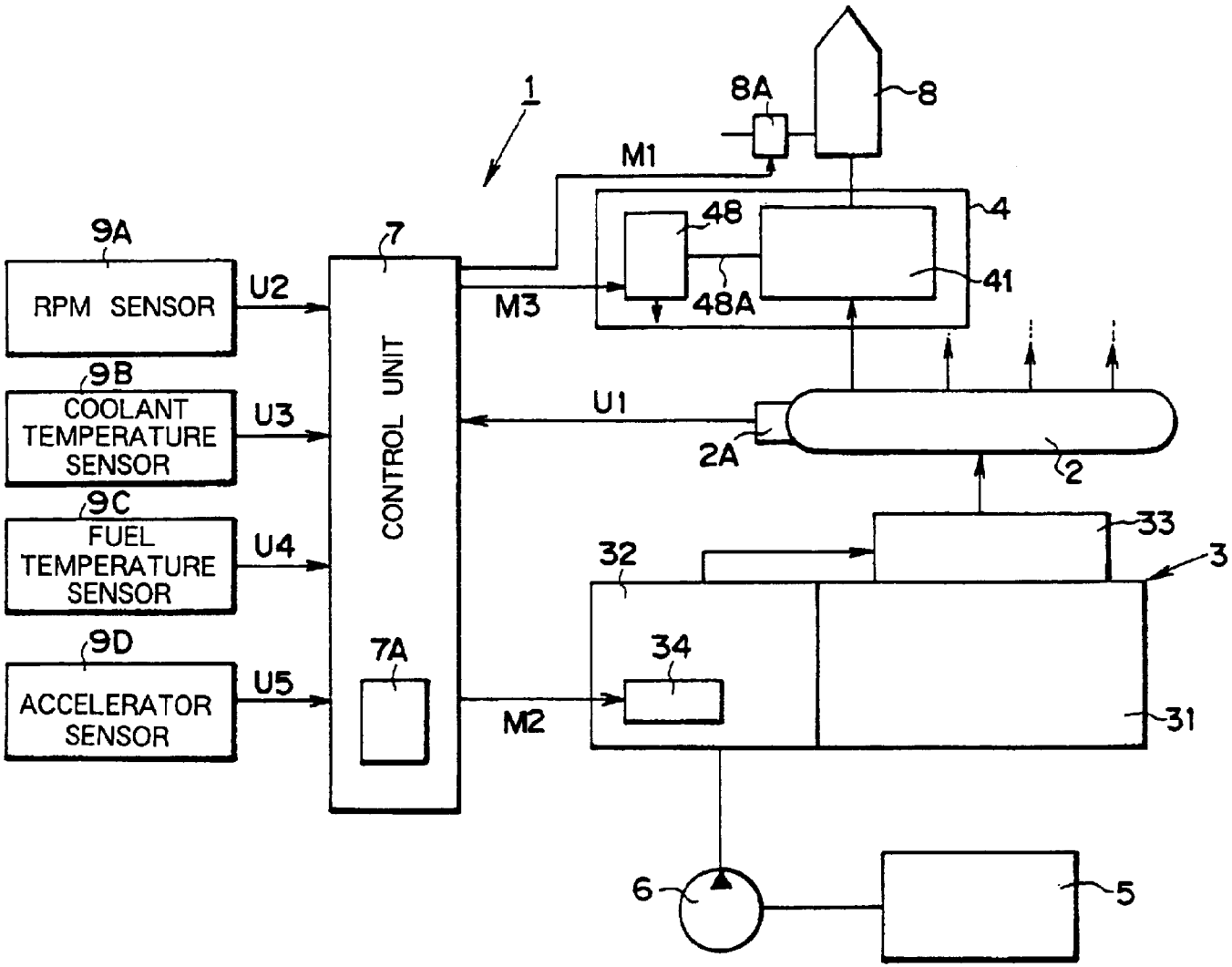
FIG. 1 is a schematic diagram showing an embodiment of the fuel injection apparatus for an internal combustion engine in accordance with the present invention.

FIG. 1 is a schematic diagram showing an embodiment of the fuel injection apparatus for an internal combustion engine in accordance with the present invention. The fuel injection apparatus 1 is a common rail fuel injection apparatus for an internal combustion engine, which is equipped with a common rail 2 and a high-pressure pump assembly 3 for supplying high-pressure fuel to the common rail 2 and is configured to supply high-pressure fuel accumulated in the common rail 2 to an injector 8 through a pressure booster 4. The injector 8 is equipped with a solenoid valve 8A for injection control and the apparatus is configured to open/close control the solenoid valve 8A in response to a first control signal M1 from a control unit 7 so that a required quantity of the high-pressure fuel is injected into an associated cylinder of an unshown diesel engine at a prescribed time point. In the interest of simplifying the drawing, only one set of the pressure booster 4 and injector 8 is shown, but there are actually provided a number of sets equal to the number of cylinders of the diesel engine.

Since the structure of the injector 8 for controlling injection by the opening/closing of the solenoid valve 8A is itself known, further detailed explanation of the structure of the injector 8 will be omitted here.

The high-pressure pump assembly 3 is constituted by integrally assembling a main high-pressure pump unit 31 driven by the diesel engine, a fuel metering unit 32 and an inlet/outlet valve 33. Fuel is supplied to the fuel metering unit 32 from a fuel tank 5 by a feed pump 6. The fuel metering unit 32 regulates the flow rate of the fuel supplied from the feed pump 6 to make the fuel pressure that required by the diesel engine and feeds the fuel to the inlet/outlet valve 33. The inlet/outlet valve 33 supplies the fuel received from the fuel metering unit 32 to a plunger chamber (not shown) of the high-pressure pump assembly 3 and supplies the fuel raised to a high pressure in the plunger chamber to the common rail 2 while preventing it from flowing back to the fuel metering unit 32. The regulation of the fuel flow rate in the fuel metering unit 32 is conducted by open/close control of a solenoid valve 34 provided in the fuel metering unit 32.

Designated by reference numeral 7 is a control unit, constituted using a microcomputer 7A, for controlling the different parts of the fuel injection apparatus 1 as explained later. The control unit 7 is input with an actual pressure signal U1 from a pressures sensor 2A that detects the fuel pressure in the common rail 2 (rail pressure). In addition, the control unit 7 is input by an RPM sensor 9A with an RPM signal U2 representing the engine speed of the diesel engine, by a coolant temperature sensor 9B with a coolant temperature signal U3 representing the coolant temperature of the diesel engine and by a fuel temperature sensor 9C with a fuel temperature signal U4 representing the temperature of the fuel supplied to the common rail 2; and the control unit 7 is further input by an accelerator sensor 9D with an accelerator signal U5 representing the amount of operation of an accelerator pedal (not shown).

The control unit 7 is configured to respond to the actual pressure signal U1, RPM signal U2, coolant temperature signal U3, fuel temperature signal U4 and accelerator signal U5 by outputting a second control signal M2 for open/close controlling the solenoid valve 34 so as to maintain the pressure of the high-pressure fuel accumulated in the common rail 2 at a required level.

The second control signal M2 output by the control unit 7 for open/close controlling the solenoid valve 34 is a pulse signal whose duty ratio is set in the control unit 7 to an output value for controlling the solenoid valve 34. This makes it possible to regulate the flow rate of the high-pressure fuel flowing to the common rail 2 from the main high-pressure pump unit 31, and this flow rate regulation makes it possible to control the pressure of the high-pressure fuel in the common rail 2 to the prescribed pressure. Since the configuration of the high-pressure pump assembly 3 whereby the solenoid valve 34 is open/close operated by such duty ratio control so as to conduct flow rate regulation of the fuel is itself known, detailed explanation regarding the high-pressure pump assembly 3 is omitted.

Figure 2:
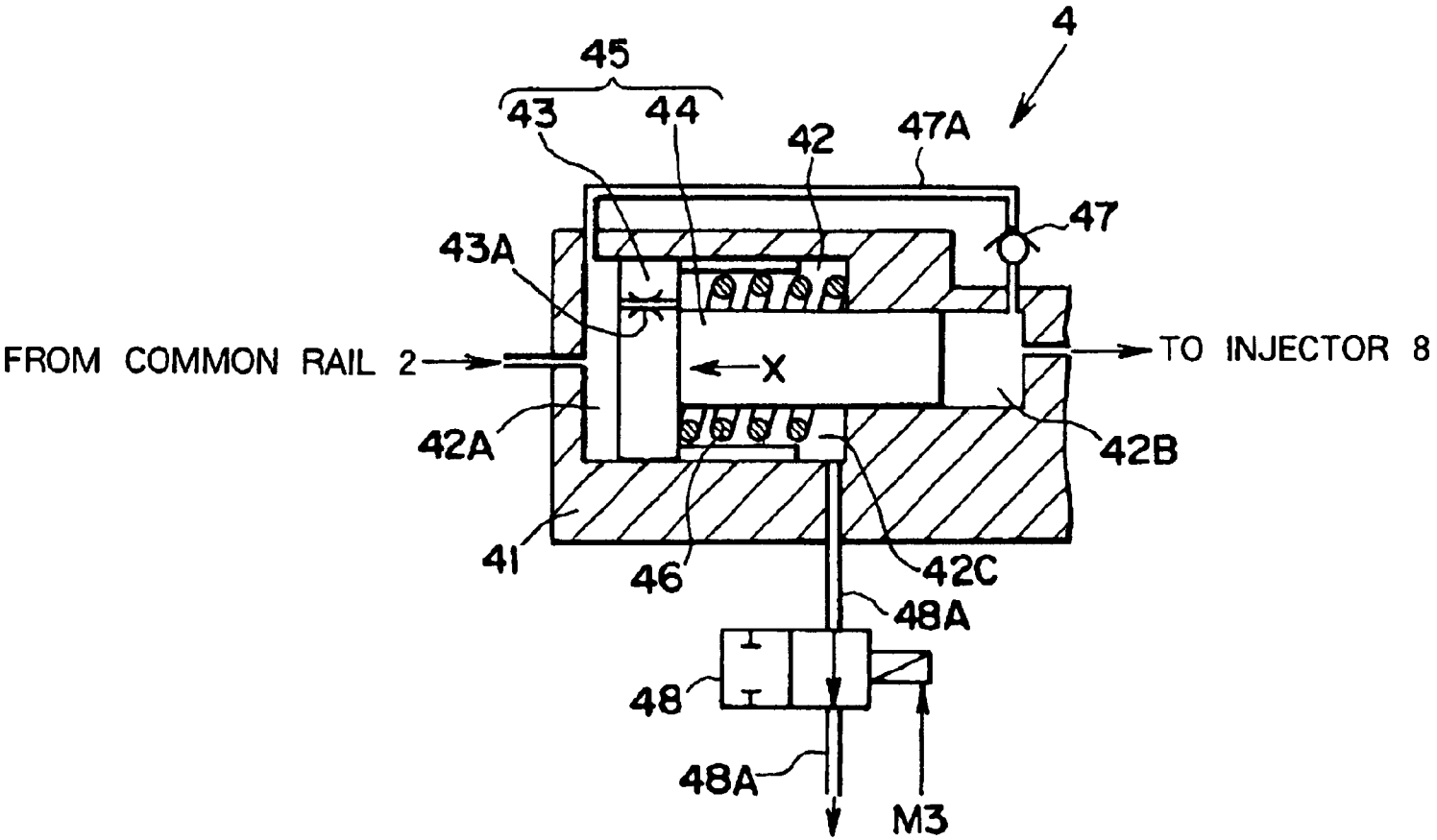
FIG. 2 is a sectional view showing structural details of a pressure booster shown in FIG. 1.

Structural details of the pressure booster 4 are shown in FIG. 2. The pressure booster 4 is a device of known structure configured such that a booster piston 45 composed of large-diameter piston 43 and a small-diameter piston 44 is housed in a cylinder chamber 42 within a main body 41 and a spring 46 spring-biases the booster piston 45 in the direction of the arrow X. It is configured to supply high-pressure fuel from the common rail 2 to a first chamber 42A divided off by the large-diameter piston 43 and to send pressure-boosted high-pressure fuel from a second chamber 42B divided off by the small-diameter piston 44 to the injector 8.

A third chamber 42C that houses the spring 46 communicates with the first chamber 42A through an orifice 43A formed in the large-diameter piston 43. The first chamber 42A and the second chamber 42B are connected through an oil duct 47A provided with a check valve 47 to form a configuration that enables high-pressure fuel to be passed only from the first chamber 42A to the second chamber 42B, whereby by the high-pressure fuel can be supplied from the first chamber 42A to the second chamber 42B. Further, the third chamber 42C is connected to the fuel low-pressure side by an oil duct 48A. This configuration enables the boosted pressure of the high-pressure fuel by the pressure booster 4 to be controlled by open/close controlling a control solenoid valve 48 provided in the oil duct 48A to regulate the fuel pressure in the third chamber 42C. The control solenoid valve 48 is constituted as an open/close valve and the close or open state of the control solenoid valve 48 is controlled in response to a third control signal M3 from the control unit 7. Since the structure of the pressure booster 4 shown in FIG. 2 is itself known, detailed explanation regarding the operation for boosting pressure will be omitted.

Figure 3:
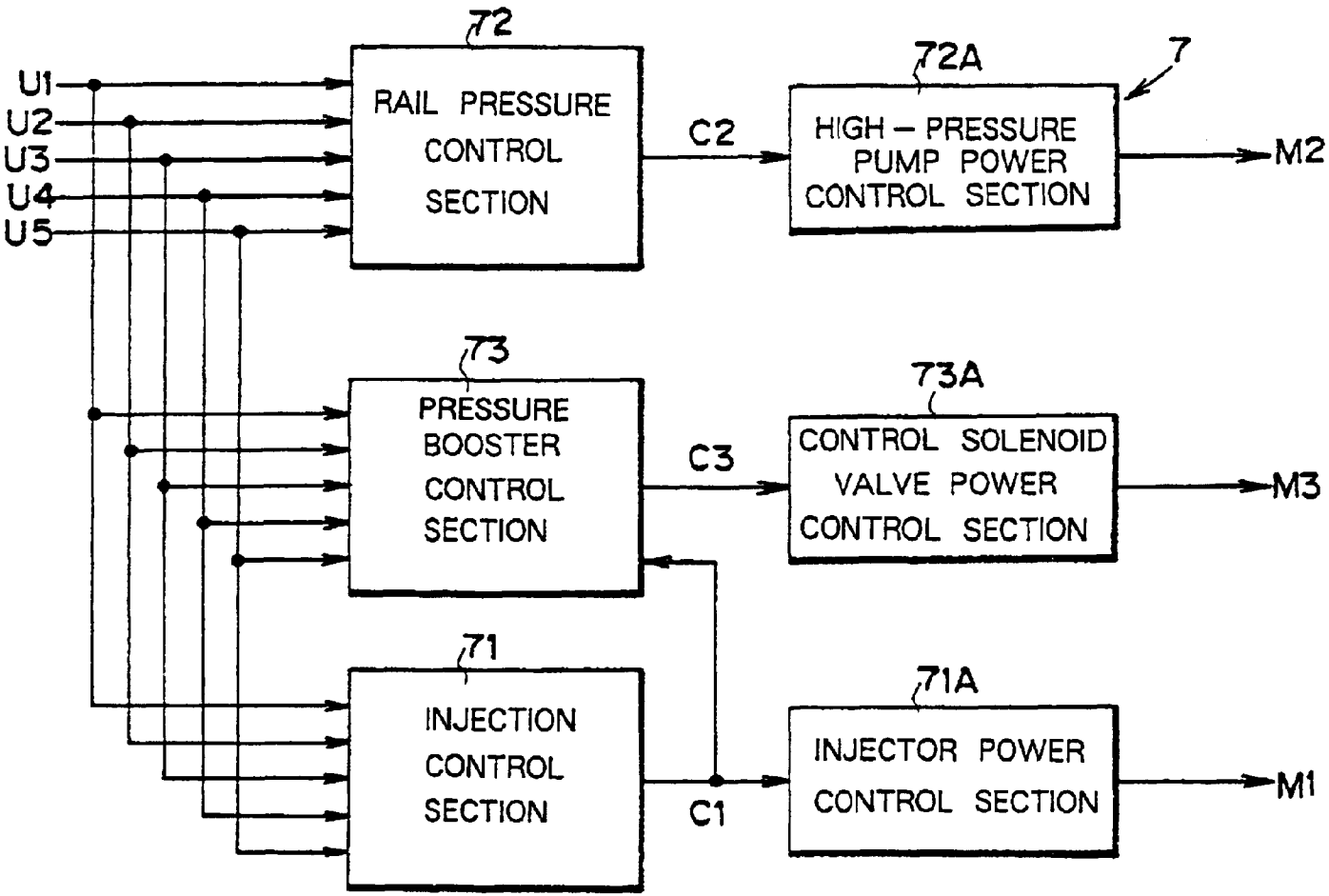
FIG. 3 is a block diagram for explaining structural details of a control unit shown in FIG. 1.

FIG. 3 shows a detailed configuration diagram of the control unit 7. In the control unit 7, 71 is an injection control section for controlling the injector 8, 72 is a rail pressure control section for controlling the rail pressure of the common rail 2, and 73 is a pressure booster control section for controlling the pressure booster 4. Each of the injection control section 71, rail pressure control section 72 and pressure booster control section 73 are input with the actual pressure signal U1, RPM signal U2, coolant temperature signal U3, fuel temperature signal U4 and accelerator signal U5 as input signals. The injection control section 71 is responsive to these input signals for computing/outputting an injection control signal C1 for controlling fuel injection from the injector 8, and the injection control signal C1 is fed to an injector power control section 71A; the injector power control section 71A outputs a first control signal M1 corresponding the injection control signal C1. Although explanation has been made here with regard to a single injector 8, actually multiple injectors are provided. While the same control is effected with respect to each injector, the details thereof are omitted.

In accordance with a conventional configuration, the rail pressure control section 72, which is a control section for controlling the fuel pressure in the common rail 2 to the optimum value, is responsive to the input signals for outputting a rail pressure control signal C2, and a high-pressure pump power control section 72A is responsive to the rail pressure control signal C2 for outputting the second control signal M2.

The pressure booster control section 73 is configured to be responsive to both the input signals and also the injection control signal C1 to output an open/close control signal C3 to a control solenoid valve power control section 73A; the control solenoid valve power control section 73A outputs the third control signal M3.

Figure 4:
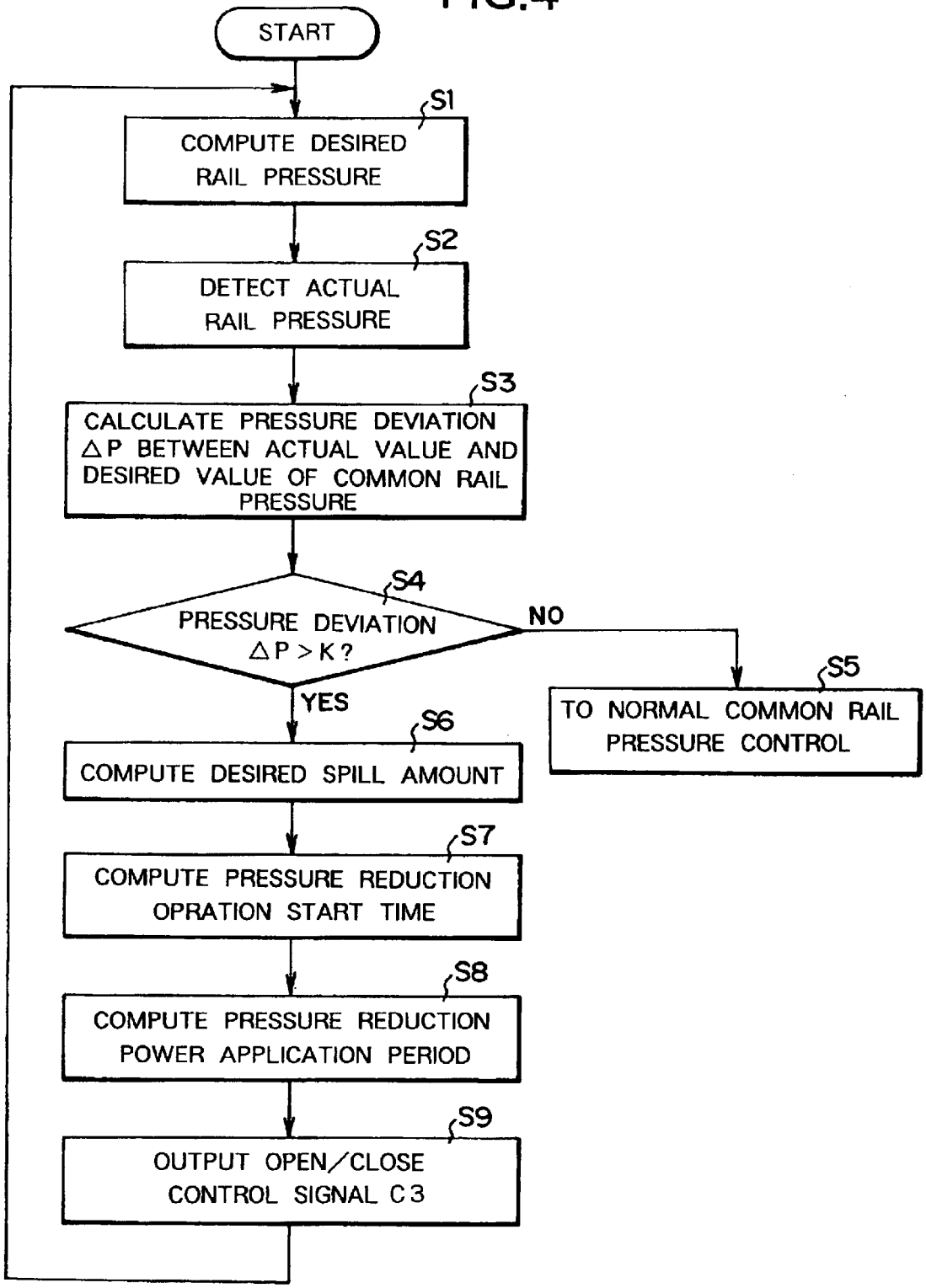
FIG. 4 is a flowchart of a control program executed in a microcomputer of the control unit for controlling the pressure booster.

Explanation regarding the pressure booster control section 73 will now be made with reference to FIG. 4. FIG. 4 is a flowchart of a control program for controlling the pressure booster 4 that is executed in the microcomputer 7A of the control unit 7. The pressure booster control section 73 will be explained based on this flowchart. When execution of the control program is initiated, first, in step S1, the desired rail pressure, i.e., the desired pressure of the fuel in the common rail 2, is computed based on the input signals U2–U5. In the following step S2, the actual rail pressure, i.e., the actual fuel pressure in the common rail 2, is detected from the actual pressure signal U1. Then, in step S3, the pressure deviation AP between the actual value PA and the desired value PT of the fuel pressure in the common rail 2 (=PA−PT) is calculated, whereafter control passes to step S4.

In step S4, it is checked whether the pressure deviation $\Delta P$ is greater than a prescribed value K for discriminating rapid pressure decrease. The prescribed value K represents a discrimination reference pressure for discriminating whether or not rapid reduction of rail pressure is necessary because the rail pressure of the common rail 2 has come to greatly exceed the desired rail pressure for a reason such as that the accelerator pedal was abruptly released.

When $\Delta P \leqq K$ in step S4, the discrimination result in step S4 is NO and control passes to step S5, in which the rail pressure control section 72 performs normal pressure control by duty ratio control of the solenoid valve 34, and feedback control is performed to make the fuel pressure in the common rail 2 the desired value.

When $\Delta P > K$ in step S4, the discrimination result in step S4 is YES, a measure is initiated to rapidly reduce the fuel pressure in the common rail 2 by opening the control solenoid valve 48.

Specifically, in the fuel injection apparatus 1, when the rail pressure in the common rail 2 assumes a high-pressure state of over a prescribed level that makes rapid pressure reduction necessary, the control solenoid valve 48 used to control the boosted pressure in the pressure booster 4 is used for the purpose of rapid pressure reduction by spilling high-pressure fuel in the common rail 2 to the low pressure side. As can be seen from FIG. 2, when the control solenoid valve 48 is opened, the pressure of the third chamber 42C declines to spill high-pressure fuel supplied from the common rail 2 to the low pressure side through the first chamber 42A, orifice 43A and third chamber 42C, whereby the rail pressure can be reduced relatively rapidly.

The rapid pressure reduction by the control solenoid valve 48 needs to be performed by spilling the required amount at a time point where there is no adverse effect on the fuel injection operation of the injector 8 and the fuel injection operation of the other injectors that are not shown.

Therefore, a desired spill amount required for pressure reduction is calculated in response to the actual pressure signal U1 in step S6, the pressure reduction operation start time, i.e., the time point of the valve opening operation of the control solenoid valve 48 for pressure reduction, is computed in step S7, and the pressure reduction power application period, i.e., the valve-open period of the control solenoid valve 48 necessary to realize the desired spill amount, is computed in step S8.

In step S9, the open/close control signal C3 for pressure reduction by controlling the valve opening operation of the control solenoid valve 48 is output based on the computation results in the steps S6, S7 and S8. The open/close control signal C3 is sent to the control solenoid valve power control section 73A (see FIG. 3) and the control solenoid valve power control section 73A applies the third control signal M3 for opening/closing the control solenoid valve 48 in accordance with the open/close control signal C3 to the control solenoid valve 48. This reduces the fuel pressure in the common rail 2 at a stroke. As a result, the excessively high fuel pressure in the common rail 2 is lowered with excellent responsiveness so that the pressure in the common rail 2 can be brought to the required target value in a short time.

Next, the rapid rail pressure reduction operation using the pressure booster 4 will be explained with reference to FIGS. 5A–5C and FIGS. 6A–6C.

FIGS. 5A–5C are graphs showing an operation example in the case of not conducting rapid pressure reduction. FIG. 5A is a graph showing the open/close operation of the control solenoid valve 48, FIG. 5B is a graph showing the fuel injection operation at the injector, and FIG. 5C is a graph showing the time-course change in the fuel injection from the injector, etc. Here, the control solenoid valve 48 is opened for a prescribed time period at time points TA, TB synchronously with fuel injection so as to lower the back-pressure of the large-diameter piston 43 and, by this, boost the fuel pressure to increase the injection quantity at the late stage of each fuel injection. In this case, the rail pressure declines owing to the opening of the control solenoid valve 48 at time point TA but returns almost to the original level by the next time point TB, so that the injection quantity decrease $\Delta Q1$ at time point TB is very small.

On the other hand, FIGS. 6A–6C are graphs showing an operation example in the case of conducting rapid pressure reduction. FIG. 6A is a graph showing the open/close operation of the control solenoid valve 48, FIG. 6B is a graph showing the fuel injection operation at the injector, and FIG. 6C is a graph showing the time-course change in the fuel injection from the injector, etc. This is an example of the case where the control solenoid valve 48 is opened for the purpose of rapid pressure reduction at time points T1 and T2 where fuel injection from the injector at time points TA and TB is not affected. At time points T1 and T2, high-pressure fuel in the common rail 2 is allowed to escape to the low-pressure side through the control solenoid valve 48, whereby the rail pressure can be rapidly reduced. As a result, the injection quantity decrease ΔQ2 at the next injection time point TB is larger than ΔQ1 in the case of FIG. 5.

The example shown in FIGS. 6A–6C was explained regarding the case of conducting the operation for pressure reduction by opening the control solenoid valve 48 twice at the time points T1 and T2. However, the number of operations of the control solenoid valve 48 for pressure reduction operation can be any number of times insofar as no problem arises in the fuel injection operation by the injector and the amount of fuel spilled each time can be appropriately determined in view of the required pressure reduction.

In accordance with this configuration, it becomes possible to effectively reduce the pressure of the high-pressure fuel in the common rail 2 in a short time using the control solenoid valve 48 preinstalled in the pressure booster, merely by making minor changes to its control section configuration or to its program. Therefore, the configuration enables the rail pressure of the common rail 2 to be reduced more rapidly than heretofore despite its low cost. As a result, since any abrupt fuel injection termination operation that occurs can be prevented from giving rise to problems in the fuel injection operation thereafter, it is possible to realize a common rail fuel injection apparatus that is low in cost and high in performance.

INDUSTRIAL APPLICABILITY

As set out in the foregoing, the common rail fuel injection apparatus of the present invention is effective for preventing abrupt fuel injection termination operation from giving rise to problems in the fuel injection operation thereafter.

What is claimed is:

1. A common rail fuel injection apparatus configured so that high-pressure fuel from a common rail for accumulating fuel supplied under pressure from a fuel supply pump is sent through a pressure booster to an injector open/closed controlled by fuel injection control means and wherein pressure boost control in the pressure booster is conducted by using a solenoid valve to regulate an amount of the high-pressure fuel supplied to the pressure booster that is spilled to the low-pressure side, the common rail fuel injection apparatus being characterized in that it comprises:

discrimination means for discriminating whether reduction of fuel pressure in the common rail is necessary, spill amount computing means for computing a high-pressure fuel spill amount necessary for pressure reduction when the discrimination means discriminates that pressure reduction is necessary, and solenoid valve control means responsive to the spill amount computing means and the fuel injection control means for open/close controlling the control solenoid valve so as to spill the high-pressure fuel to the low-pressure side at a time point when fuel injection from the injector is not being conducted.

2. A common rail fuel injection apparatus as claimed in claim 1, wherein the control solenoid valve is open/close controlled so as to spill the high-pressure fuel to the low-pressure side for a prescribed time period at said time point.

3. A common rail fuel injection apparatus as claimed in claim 1, further comprising spill amount computing means for computing a high-pressure fuel spill amount necessary for pressure reduction, the solenoid valve control means open/close controlling the control solenoid valve in response to the spill amount computing means and the fuel injection control means so as to spill said spill amount of the high-pressure fuel to the low-pressure side at a time point when fuel injection from the injector is not being conducted.

4. A common rail fuel injection apparatus as claimed in claim 1, configured such that the discrimination means is equipped with desired pressure computing means for computing a desired pressure of the common rail and a rail pressure sensor for detecting actual pressure of the common rail and discriminates whether pressure reduction is necessary by comparing the desired pressure and the actual rail pressure.

* * * * *